US005136287A

United States Patent [19]

Borenstein

[11] Patent Number: 5,136,287

[45] Date of Patent: * Aug. 4, 1992

[54] TRAFFIC-RELATED MESSAGE SIGNAL USING LIGHT-EMITTING DIODES

[76] Inventor: Arnold Borenstein, 2818 W. Chase, Chicago, Ill. 60645

[ * ] Notice: The portion of the term of this patent subsequent to Feb. 20, 2007 has been disclaimed.

[21] Appl. No.: 572,892

[22] Filed: Aug. 24, 1990

Related U.S. Application Data

[63] Continuation-in-part of Ser. No. 240,072, Sep. 2, 1988, Pat. No. 4,954,822.

[51] Int. Cl.[5] ..... G08G 1/07

[52] U.S. Cl. ..... 340/925; 340/762; 340/907; 340/815.03; 362/800

[58] Field of Search ..... 340/925, 908, 762, 782, 340/723, 907, 815.03; 362/800

[56] References Cited

U.S. PATENT DOCUMENTS 2,194,614 9/1937 Rayburn .
3,368,198 1/1965 Eikenberry et al. .
3,863,251 1/1975 Gould et al. .
4,271,408 6/1981 Teshima et al. ..... 362/800
4,298,869 11/1981 Okuro ..... 362/800
4,308,572 12/1981 Davidson et al. ..... 362/103
4,654,629 3/1987 Bezos et al. .
4,733,486 3/1988 Gawell ..... 40/451

*Primary Examiner*—Donnie L. Crosland
*Attorney, Agent, or Firm*—Laff, Whitesel, Conte & Saret

[57] ABSTRACT

A traffic message signal device includes a housing having a display structure. The display structure includes a non-reflective support panel supporting a plurality of light-emitting diode elements arranged in a configuration defining a traffic-related message. The light-emitting diode elements are high intensity limited dispersion L.E.D.s which emit light in an attenuated angular spread about a central axis. The light-emitting diode elements are supported on board members with their central axis generally parallel to each other and generally perpendicular to the support panel.

32 Claims, 5 Drawing Sheets

FIG. 4
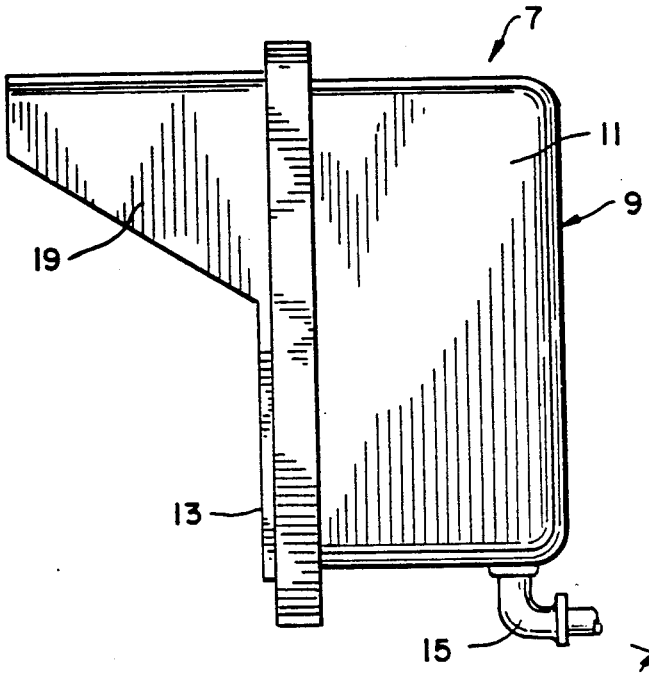
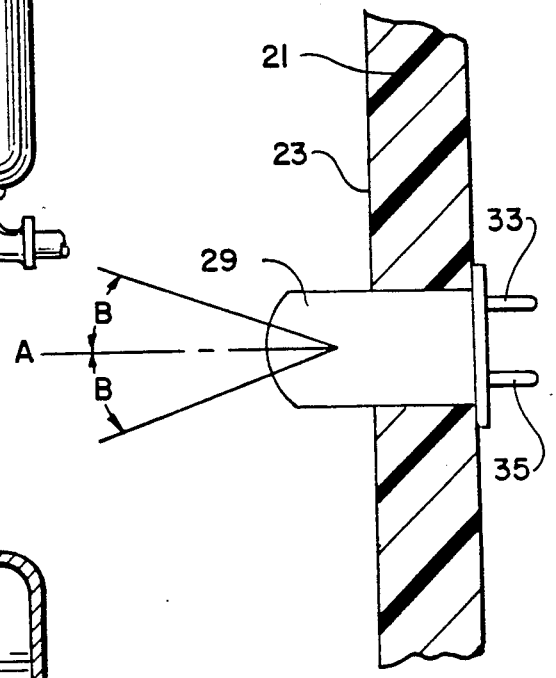
FIG. 6
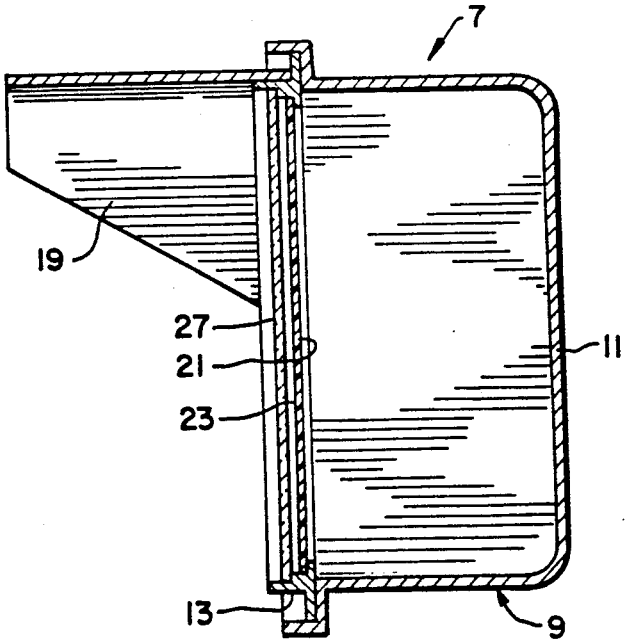
FIG. 5

TRAFFIC-RELATED MESSAGE SIGNAL USING LIGHT-EMITTING DIODES

This application is a continuation-in-part of my copending application Ser. No. 07/240,072, filed Sep. 2, 1988, now U.S. Pat. No. 4,954,822.

BACKGROUND OF THE INVENTION

1. Field of the Invention

This invention relates to traffic signals.

2. Description of the Prior Art

The conventional traffic signal device contains an incandescent lamp supported in the appropriate place in a reflection containment to provide generally parallel beams of light to illuminate the visible display of the traffic signal device. The incandescent lamps in conventional traffic signal devices usually consume between 69 and 135 watts of power, depending upon how much brightness is required to overcome ambient light conditions around the signal device. The life expectancy of these bulbs is generally in the area of 8,000 hours of burning time. The power demands of these incandescent lamps result in cost to the entity responsible for operation of the signal, and the lifetime of the lamp involves additional cost due to the need for work crews to replace the lamps relatively frequently. Also, the cost of manufacture of the signal is greater due to the cost of hinges, fasteners, and gaskets necessary to provide ready access to the interior for lamp replacement.

An additional problem with conventional traffic devices commonly occurs in a number of specific signal applications, particularly in pedestrian WALK/DON'T WALK signal devices. The usual arrangement of pedestrian signal devices is to have two displays, one display having a symbol indicating WALK, and the other display having a symbol indicating DON'T WALK. When sunlight shines on the signal displays, it will frequently produce what is known as phantom image. In a phantom image, the sunlight reflects off the display surface, which is usually reflective prismatic material similar to that used in automobile tail lights, and gives the false impression that the display is illuminated, when in fact it is not.

Reference is made to U.S. Pat. No. 4,308,572 which discloses the use of diodes in clothing or on fabric or other displays. However, none of these disclosures relate to traffic signals which have been made and tested by me to obtain a high resolution signal far superior to those presently in use and which can be easily seen in various weather conditions.

Signals have been provided with shades or hoods in an attempt to overcome this problem, but with only limited success, since it is very difficult to exclude sunlight from the display while providing visibility of the display to traffic.

SUMMARY OF THE INVENTION

Accordingly, it is an object of this invention to provide a traffic-related message signal device which has low energy requirements and a long lifetime to reduce costs of operation. It is also an object to provide a traffic-related message signal device which avoids the phantom image problem of the prior art.

This is achieved by providing a traffic-related message signal device which comprises a non-reflecting panel which supports a number of high-intensity light-emitting diode (L.E.D.) elements. The L.E.D. elements are organized in the shape of any symbol, character, or group of characters desired, such as international traffic control symbols, words, or a substantially solid field of color.

The L.E.D. elements have very low power demands, and have a life expectancy in the millions of hours at the voltage used in the present invention.

A plurality of symbols may be placed on the same panel of the traffic signal device in this invention, and the L.E.D. elements which make up each symbol are provided with separate power supplies so that the symbols may be displayed selectively. The L.E.D. elements do not have the reflective properties of the prismatic displays of conventional traffic signal devices, and therefore there is no problem of phantom image.

BRIEF DESCRIPTION OF THE DRAWINGS

FIG. 4 is a side view of the pedestrian traffic signal device.

FIG. 5 is a sectional view of the pedestrian traffic signal device taken along line 5—5 of FIG. 1.

FIG. 6 is a detailed view of one of the light emitting diode elements of the traffic signal device.

DETAILED DESCRIPTION OF THE INVENTION

FIGS. 1 to 6 disclose a first embodiment of the traffic signal device of this invention.

Figure 1:
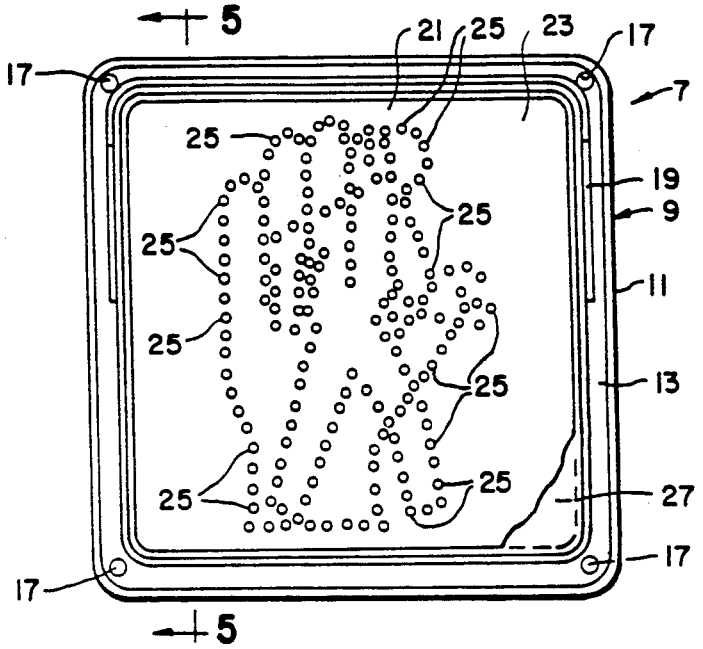
FIG. 1 is a front elevational view of a first embodiment of the invention in the form of a pedestrian traffic signal device.

A pedestrian traffic signal device is generally indicated at 7. As best shown in FIGS. 1, 4 and 5, the signal device 7 includes a housing 9. The housing 9 includes a rear enclosure 11 and a display support structure 13 which together form a substantially enclosed box. Access conduit 15 secured to rear enclosure 11 communicates with the interior of the device 7, and supportive wiring for the signal device 7 such as wiring to a control device, or other wiring, extends through conduit 15 into the device 7. The display support structure 13 is secured to rear enclosure 11 by securement means, such as screws 17, to create a substantially weather-tight seal therebetween for protecting the components within the device. A visor or hood 19 is supported on the device to shade the display of the device in accordance with national standards.

The display support structure 13 includes a support plate portion 21 which has a substantially planar surface portion 23. A plurality of signal elements some examples of which are designated by reference character 25 are supported on support plate portion 21. A protective cover or shield plate 27 made of substantially transparent or non-opaque material such as acrylic material or polycarbonate is supported and spaced forwardly from the support panel 21 and the signal elements 25. Cover 27 substantially covers the front of the device, and is partially cut-away in FIGS. 1, 2, and 3.

Each of the signal elements: 25 is a high intensity light-emitting diode element or L.E.D. 29 supported on support panel 21, as best shown in FIG. 6. High intensity L.E.D.s differ from conventional light-emitting diodes in the brilliance of output therefrom. Exemplary of this type of high intensity L.E.D. are the L.E.D.s sold by Hewlett-Packard under the brand name ULTRABRIGHT or DOUBLE-HETERO JUNCTION, AlGaAs.

The increased brilliance of the high intensity L.E.D. is achieved by changes in the chemistry of the doping material used in the L.E.D., and also by providing reflector structure or other attenuating means which limits the dispersion of light emitted by the L.E.D., so that the emitted light is primarily within a conical space defined by an acute angular displacement B from the central axis A of the L.E.D. The magnitude of angle B may vary depending on the L.E.D. used, but will generally be less than about 45 degrees, and preferably generally in the range of 4 to 30 degrees.

The L.E.D.s 29 are supported on the display support structure 21 so that the central axes A of the L.E.D.s are generally parallel to each other for optimal visibility of the display. As best shown in FIG. 6, each L.E.D. 29 is supported in an aperture 31 in support plate 21 so that the central axis of the L.E.D. 27 is substantially perpendicular to the surface 23 of support plate 21. Each L.E.D. has two leads 33 and 35, and when current is applied through leads 33 and 35 the L.E.D. 29 becomes illuminated. The surface 23 is non-reflective to provide a dark, contrasting back drop to the L.E.D. 29 when illuminated.

The signal elements 25 are organized in sets of signal elements which are positioned on the support plate portion 21 in configuration or patterns corresponding to or defining traffic control symbols. In the first embodiment shown, the signal elements are organized in two sets, one set corresponding to a stylized figure of a walking humanoid (the international symbol for "WALK") and the other set corresponding to an upraised hand (the international symbol for "DON'T WALK"). The precise shape of these symbols is defined by the Institute of Transportation Engineers (ITE). The signal elements 25 are arranged in single file around the perimeter of the symbol. The spacing between the L.E.D.s is between about ¼ inch and ½ inch, with the optimal distance determined by the requirements of the display.

Figure 2:
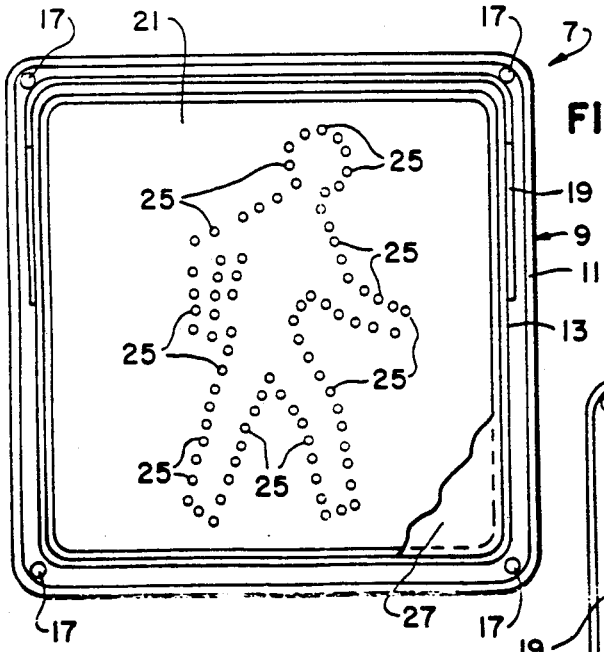
FIG. 2 is a view as in FIG. 1, but showing the symbol which is visible to pedestrians when the WALK symbol is illuminated.
Figure 3:
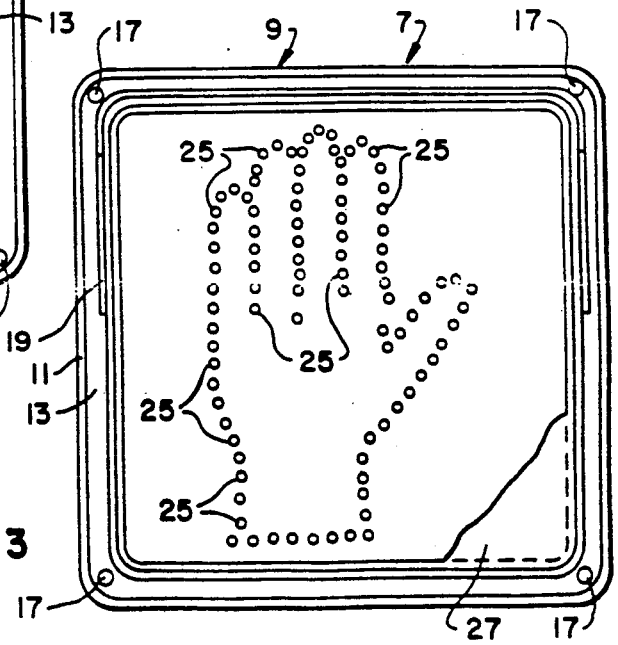
FIG. 3 is a view as in FIG. 1, but showing the symbol which is visible to pedestrians when the DON'T WALK symbol is illuminated.

The distinct sets of signal elements 25 are best shown in FIGS. 2 and 3. FIG. 2 shows those signal elements 25 which are illuminated to display the WALK symbol, and FIG. 3 shows those signal elements which are illuminated to display the DON'T WALK symbol. The L.E.D.s are available in a variety of colors, and in the preferred embodiment, red L.E.D.s are used for the DON'T WALK symbol, and green L.E.D.s are used for the WALK symbol.

Figure 7:
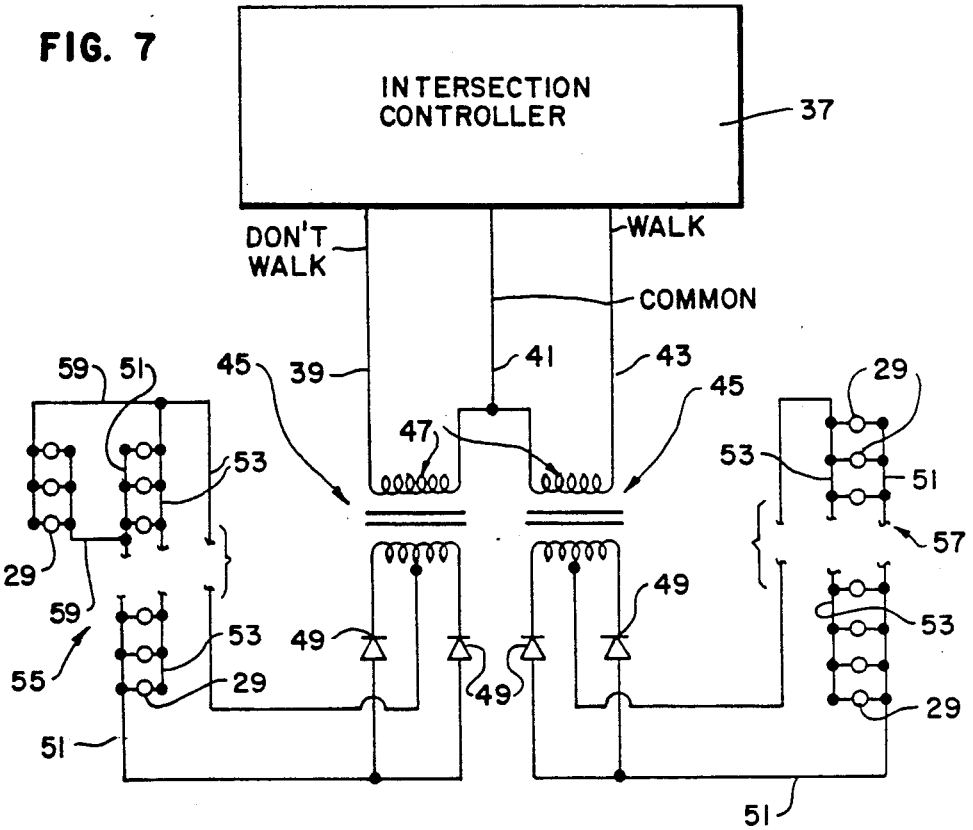
FIG. 7 is schematic view of the circuit of the pedestrian traffic signal device.

A general schematic of the traffic signal device 7 is shown in FIG. 7. The power supply which provides electrical current to the signal elements 25 includes a controller indicated at 37 which controls the signals at an intersection or other location, as is well known in the art. The controller 37 is normally external to the traffic control device 7, and includes communicating wires 39, 41, and 43 which extend to the traffic signal device 7. The controller 37 selectively supplies one side of a 115 volt alternating current supply to wire 39 to activate the DON'T WALK signal, and to wire 43 to activate the WALK signal. Wire 41 carries a common opposite side of the alternating current to complete the circuit when current is applied to either wire 39 or 43.

Each wire 39 and 43 connects with a respective full phase rectifier indicated at 45. The rectifiers 45 each include a step-down center tap transformer 47 which reduces the peak 23 voltage to less than 6 volts and preferably to between 1 and 3 volts. In the preferred embodiment the peak voltage applied to the L.E.D.s is approximately 2.1 volts, at which voltage the life expectancy of the high intensity L.E.D.s is in the millions of hours. Diodes 49 direct the positive side of the transformer output to conductor 51 and the center tap of the transformer connects the negative side to conductor 53, yielding low voltage full-wave rectified direct current.

The set of L.E.D.s 29 representing the DON'T WALK symbol is indicated at 55 and the set of L.E.D.s 29 representing the WALK symbol is indicated at 57. Conductor 51 is connected to one lead 33 of each L.E.D. 29 in the associated set, and conductor 53 is connected to the other lead 35 of each L.E.D. 29 in the set. If the shape of the traffic symbol requires it, the conductors 5 and 53 may be provided with branch portions 59 to contact all L.E.D.s 29 in the set. The L.E.D.s 29 are wired in parallel, so that in the event of failure of an L.E.D., the remaining L.E.D.s remain operable.

To reduce the cost of manufacturing, the conductors 51 and 53 may take the form of conductive material secured to a board member, as in a printed circuit board. The support plate 21 may be the board of a printed circuit board, having the conductors 51 and 53 applied to the rear surface thereof, and having nonreflective material on the forward surface 23 thereof.

If it is desired to operate the signal at a reduced intensity, a switch may be provided to interrupt current through one of the diodes 49, with the result that the output is half-wave rectified direct current. Another method of reducing the intensity of the L.E.D.s is to circumvent the diodes 49 and apply low voltage alternating current to the L.E.D.s.

The longevity of the L.E.D.s significantly reduces the cost of maintenance of the traffic signal device. In addition, the L.E.D.s require very little power to operate. To appreciate the energy efficiency of traffic signal devices of this invention, it should be appreciated that the pedestrian traffic signal device 7 described above uses less than 5 watts of power, in contrast to conventional incandescent traffic signal lights which normally use 60 watts or more of power. This invention accordingly results in a savings of more than 90% on energy cost of operating the device.

Additionally, the displays of this invention are not reflective, and therefore present no phantom image problem.

It will be understood that while a pedestrian signal has been shown above, the benefits cf this invention may be applied to a variety of other applications, such as intersection control lights, indicators, and any other vehicular, or pedestrian may include pictorial symbols, words such as WALK, DON'T WALK or STOP, or the signal elements may be grouped together to form a substantially solid field of color when illuminated, as in a conventional red/green/yellow intersection traffic light. In addition to symbols intended for controlling traffic, the invention may also be advantageously used to display any other symbols or messages of interest to vehicular, pedestrian, or other traffic, including messages having merely advisory or informational impact. Thus, a "traffic-related" message is any indication or message directed to traffic whether for control or informational purposes. Accordingly, FIGS. 8–15 disclose additional embodiments of the invention for displaying a wider variety of vehicular and pedestrian traffic-related messages.

Figure 8:
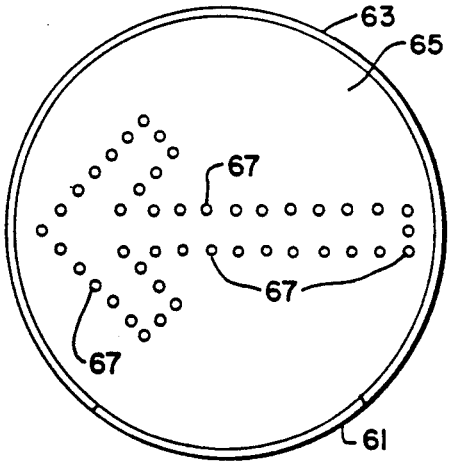
FIG. 8 is a front elevational view of a second embodiment of the invention in the form of a directional signal.

FIG. 8 discloses a second embodiment of the invention in the form of a directional arrow. The housing 61 is generally circular and has a visor 61 extending about 300 degrees therearound. A display support structure 65 supports a plurality of high-intensity L.E.D. signal elements 67 which are wired in parallel and connected with a power supply similar to that used with the pedestrian signal described above. The signal elements are arranged in a pattern of an arrow.

Figure 9:
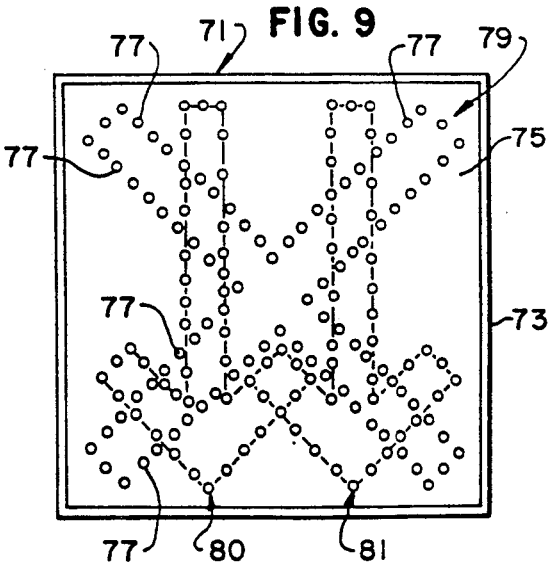
FIG. 9 is a front elevational view of a third embodiment of the invention in the form of a reversible lane traffic control device.

FIG. 9 discloses third embodiment of the invention in the form of a reversible lane control signal device. The housing 71 includes a display support structure 73 which includes a support panel 75 which supports a plurality of high intensity L.E.D. signal elements 77 similar to those described above. The signal elements 77 are organized in three patterns which are connected with a power supply for independent illumination of each of the patterns. One of the patterns is an X, generally indicated at 79. The other two patterns are laterally spaced patterns of downward-pointing arrows generally indicated at 80 and 81. The L.E.D. elements 77 which make up the X pattern 79 are red in color. The L.E.D. elements 77 which define one of the arrows 80 and 81 are amber or yellow in color, and the L.E.D. elements 77 which make up the other of the arrows 80 and 81 are green in color. Other lane control devices according to the present invention may be constructed having a different number or combination of symbols or colors. For example, the yellow arrow could be omitted from the device of FIG. 9, resulting in a lane control signal having only a red X and a green arrow.

Figure 10:
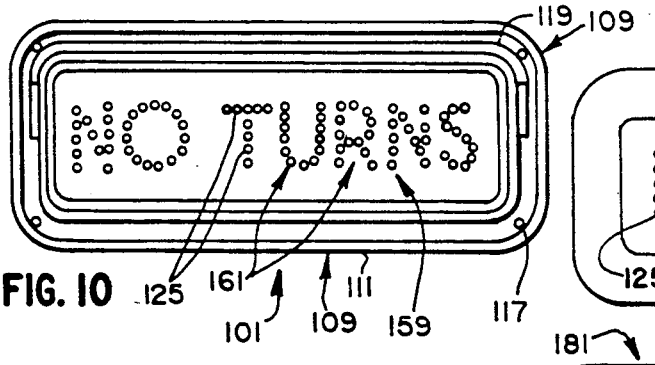
FIG. 10 is a front elevational view of a fourth embodiment of the invention in the form of a traffic control device displaying letter symbols.

FIG. 10 discloses a fourth embodiment of the invention in the form of a traffic control device 101 displaying a traffic control message 159. The traffic control message 159 is preferably any appropriate message composed of one or more readable words, abbreviations, or the like, expressed in a human language, such as the exemplary message "NO TURNS" shown in FIG. 10. The message 159 is composed of one or more individual character symbols such as letters 161, which are themselves composed of one or more individual signal elements in the form of L.E.D.s 125. As used herein, the term "character" means an individually recognizable element of a message, including a letter, number, punctuation mark, or any other recognizable message constituent.

The device 101 is preferably constructed in a manner similar to that of the previous embodiments. For example, the device 10 preferably has a housing 109 including a rear enclosure 111, a display support structure 113, and a visor or hood 119. The display support structure 113 is preferably secured to rear enclosure 111 by appropriate fasteners 117, such as screws, to create a substantially weather-tight seal therebetween for protecting the components within the device.

When illuminated, the signal elements 125 combine to form character symbols 161 in the manner of the previously described embodiments. The signal elements 125 may be placed in any appropriate arrangement which forms the desired characters. For example, as shown in FIG. 10, character segments are formed by single-width arrangements of the signal elements, but other arrangements, such as the block-outline style used for the symbols of FIGS. 8 and 9, could also be used.

The electrical components of the device 101 are preferably connected essentially as shown in the schematic diagram of FIG. 7. The circuit of FIG. 7 is designed to accommodate a traffic signal device having two independently selectable illuminated symbols, and therefore provides a separate power supply circuit for each symbol. Because the device 101 as shown in FIG. 10 displays a single message, all portions of which are simultaneously illuminated, the components of FIG. 7 required for one of its two symbols may be omitted.

Figure 11:
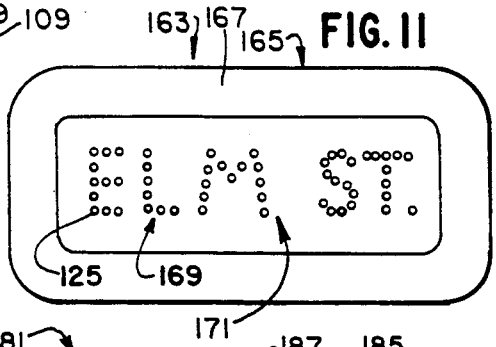
FIG. 11 is a front elevational view of a fifth embodiment of the invention in the form of an informational sign employing letter symbols.

FIG. 11 discloses a fifth embodiment of the invention in the form of a traffic message signal device 163 displaying a traffic-related informational or advisory message. The i informational message 171 is preferably any appropriate message composed of one or more characters forming at least one word, abbreviation, or the like, expressed in a human language, such as the exemplary message "ELM ST." shown in FIG. 11. The message 171 is composed of individual characters 169, which are themselves composed of one or more individual L.E.D. signal elements 125.

The device 163 is preferably constructed in a manner generally similar to that of the previous embodiments. For example, the device 163 preferably has a housing 165 including a rear enclosure, and a display support structure (not shown). In some applications, viewing from a relatively wide angle may be desirable, and the visor or hood of the previously described embodiments may be omitted as shown in FIG. Il. The device 163 preferably includes an electrical circuit similar to that described in conjunction with the embodiment of FIG. 10 to power the signal elements 125.

Figure 12:
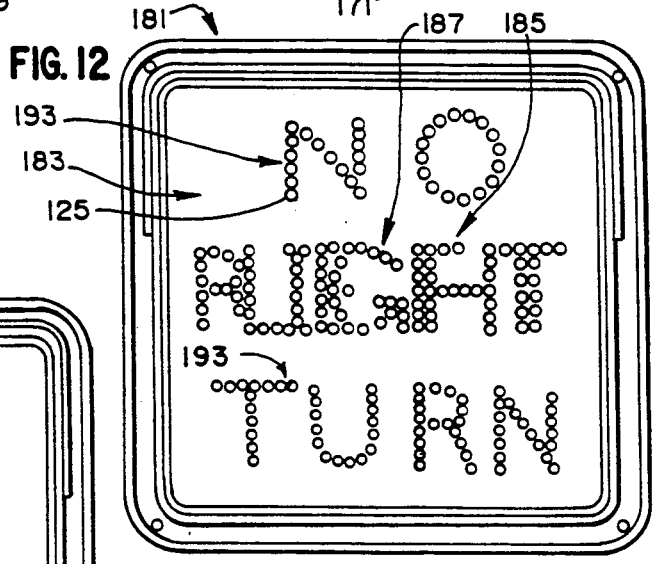
FIG. 12 is a front elevational view of a sixth embodiment of the invention in the form of a traffic control device capable of displaying either one of two alternative messages in the form of letter symbols.
Figure 13:
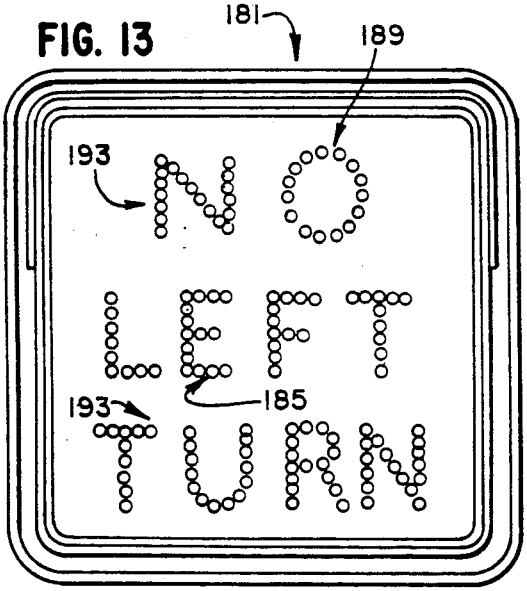
FIG. 13 is a view as in FIG. 12, showing the first message selected.
Figure 14:
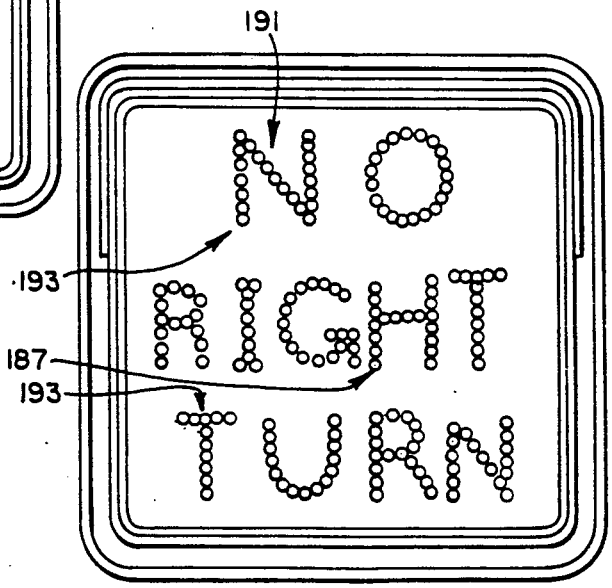
FIG. 14 is a view as in FIG. 12, showing the second message selected.

FIGS. 12–14 disclose a sixth embodiment of the invention in the form of a traffic message signal device 181 displaying one of two selectable traffic-related messages 183. As best depicted in FIG. 13, a first message 189 selectably displayed by the device 181 is "NO LEFT TURN". As best depicted in FIG. 14, a second message 191 selectably displayed by the device 181 is "NO RIGHT TURN". The words "NO" and "TURN" are common to both messages 189, 191, and this common portion is designated as 193. The portion 185 of the first message 189 unique to that message consists of the word "LEFT". The portion 187 of the second message 191 unique to that message consists of the word "RIGHT". As best depicted in FIG. 12, the signal elements 125 forming unique portions 185, 187 of the messages are superimposed. A signal element 125 is visible only when illuminated, so that the displayed message may be selected by illuminating only those signal elements forming a part of the desired message. If none of signal elements 125 are illuminated, no message is visible.

In operation, the common portion 193 of the messages may be continuously or intermittently illuminated as required by the application. The displayed message may be selected by illuminating the particular one of the unique portions 185, 187 corresponding to the selected message 189, 191 respectively. Thus, illuminating the common portion 193 and unique portion 185 forms the first message 189 "NO LEFT TURN".

Figure 16:
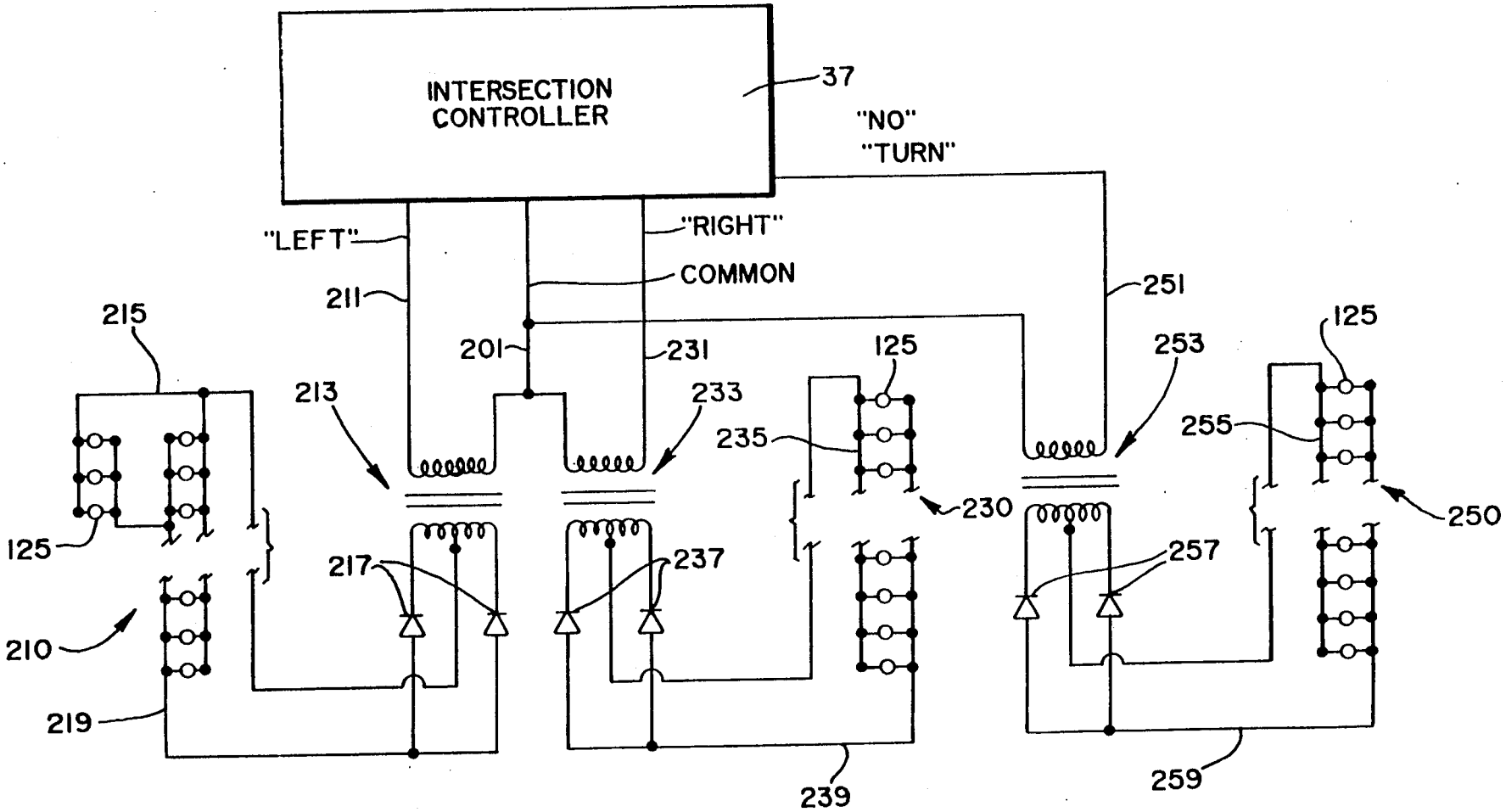
FIG. 16 is a schematic diagram of an appropriate circuit for powering the embodiments of FIGS. 12–14.

The device 181 is preferably constructed in a manner generally similar to that of the previous embodiments. The device 181 preferably includes an electrical circuit as shown in FIG. 16. The circuit of FIG. 16 is generally similar to the circuit of FIG. 7 described in conjunction with the embodiment of FIG. 1 to power the display elements 25. However, because it is desirable to control the illumination of the common portion 193 and each of the unique portions 185, 187 of message 183 independently, the circuit of FIG. 16 comprises separate first, second, and third power supply circuits 210, 230, and 250, corresponding to the first unique portion 185, the second unique portion 187, and the common portion 193 respectively of the message 183. When it is desired that the "LEFT" portion 185 of the message be illuminated, first power supply circuit 210 preferably receives 110 V AC power from intersection controller 37 across power lead 211 and common lead 201. Transformer 213 preferably reduces the peak voltage to between 1 and 3 volts. Diodes 217 are connected in a full-wave rectifier configuration to rectify the output of transformer 213, thereby providing pulsating DC to L.E.D. signal elements 125 via leads 215 and 219. All of the L.E.D. signal elements 125 forming the "LEFT portion 185 of the message are connected in electrical parallel, and would therefore be simultaneously illuminated.

When it is desired that the "RIGHT" portion 187 of the message be illuminated, second power supply circuit 230 preferably receives 110 V AC power from intersection controller 37 across power lead 231 and common lead 201. Transformer 233 preferably reduces the peak voltage to between 1 and 3 volts. Diodes 237 are connected in a full-wave rectifier configuration to rectify the output of transformer 233, thereby providing pulsating DC to L.E.D. signal elements 125 via leads 235 and 239. All of the L.E.D. signal elements 125 forming the "RIGHT" portion 187 of the message are connected in electrical parallel, and would therefore be simultaneously illuminated.

For the common portion 193 of the message to be illuminated, third power supply circuit 250 preferably receives 110 V AC power from intersection controller 37 across power lead 251 and common lead 201. Transformer 253 preferably reduces the peak voltage to between 1 and 3 volts. Diodes 257 are connected in a full-wave rectifier configuration to rectify the output of transformer 253, thereby providing pulsating DC to L.E.D. signal elements 125 via leads 255 and 259. All of the L.E.D. signal elements 125 forming the common portion 193 of the message are connected in electrical parallel, and would therefore be simultaneously illuminated.

Since the intersection controller 37 controls the three sections of the device independently, the device 181 of FIGS. 12–14 can selectably display the following useful messages: "NO LEFT TURN", "NO RIGHT TURN", and "NO TURN"; the device may also appear blank, i.e. convey no message.

Figure 15:
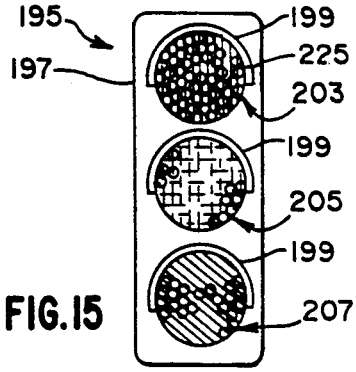
FIG. 15 is a front elevational view of a seventh embodiment of the invention in the form of an automobile traffic signal device employing color symbology.

FIG. 15 is a front elevational view of a seventh embodiment of the invention in the form of a color-coded automobile traffic signal stop-light device 195. In a typical implementation, the device 195 has three display sections 203, 205, 207 for displaying essentially solid fields of color for viewing by traffic. Each display section includes a plurality of signal elements 225 arranged sufficiently closely to give the appearance of an essentially solid field of color. The signal elements 225 are preferably high-intensity L.E.D. devices as previously described herein. The signal elements radiate colored light, which colors are preferably selected to be appropriate for an automobile traffic signal. For example, the display sections 203, 205, and 207 may include signal elements 225 respectively producing red, yellow, and green light. The device 195 preferably has a suitable enclosure 197; visors 199 are preferably provided to shade the display sections.

While specific embodiments have been disclosed herein, the invention is not limited thereto, and the language used in this specification is intended as descriptive rather than limiting, as those skilled in the art with this specification before them will be able to make modifications therein without departing from the spirit of the invention claimed.

What is claimed is:

1. A traffic message signal device for providing a high resolution signal to vehicular and pedestrian traffic comprising:

a display support structure including a non-reflective panel member which is substantially flat;

a set of signal elements supported on said panel;

said signal elements being arranged in a configuration corresponding to a message having a traffic-related significance in a human language;

each of the signal elements comprising a high intensity light-emitting diode element having an angle of dispersion about a central axis which is substantially perpendicular to said panel member; and power supply means for supplying electrical power being connected with said light-emitting diode elements, and light-emitting diode elements generating light responsive to power being applied thereto, said power supply means including a center tap secondary winding of a step-down transformer having a first outboard tap, a second outboard tap and a center tap;

a first diode in a first conductor connected to said first outboard tap; and a second diode in a second conductor connected to said second outboard tap;

said diodes being commonly oriented to selectively allow conduction in the first and the second conductor whereby the traffic-related message formed by said diodes is only perceived by traffic when the diodes are illuminated.

2. The invention according to claim 1, and said light-emitting diode elements having an angle of dispersion of less than 45 degrees from a central axis thereof of light generated thereby, and said light-emitting diode elements being supported so that the central axis of each of the light-emitting diode elements is generally perpendicular to said panel member, so that the light emitted from said diodes is directly perceived by traffic as the traffic-related message.

3. The invention according to claim 1, wherein said light-emitting diodes are connected in parallel.

4. The invention according to claim 1, and a substantially planar non-opaque cover means spaced from the panel member and covering the light-emitting diode element, said light-emitting diode elements only being visible through said cover means when said light-emitting diode elements are illuminated.

5. The invention according to claim 4, and said cover means comprising a plate of substantially transparent material selected from the group consisting of acrylic material and polycarbonate material.

6. The invention according to claim 1, wherein said traffic-related message comprises at least one character recognizable to human viewers;

said light-emitting diode elements being positioned substantially only in single file generally along only the perimeter of each character of the represented traffic-related message so that the outline of each character forming the traffic-related message is perceived.

7. The invention according to claim 6, and each of the light-emitting diode elements being spaced generally in the range of from about one quarter inch to about one-half inch center to center from the nearest adjacent light-emitting diode elements forming each character of the traffic-related message.

8. The invention according to claim 1, and said light-emitting diode elements being wired in parallel relative to each other.

9. The invention according to claim 1, and said light-emitting diode elements each having first and second leads connected thereto, said light-emitting diode element generating light when current is applied to flow through said leads, a first conductor being connected with the first leads of the light-emitting diode elements;

a second conductor connected with the second leads of the light-emitting diode elements;

the power supply means having first and second electrically opposite conductor portions connected with the first and second conductors respectively, whereby the light-emitting diode elements are wired in parallel.

10. The invention according to claim 9, and said conductors comprises conductive material secured to a panel member.

11. The invention according to claim 10, and said panel and said conductors are an etched printed circuit board.

12. The invention according to claim 1, and the power supply means comprising a controller selectively supplying the flow of electrical power to the light-emitting diode elements forming a single illuminated traffic control signal.

13. The invention according to claim 12, and the power supply means including a source of alternating current, and converter means for converting the alternating current to relatively lower voltage direct current, said converter means being connected with the light-emitting diode elements and providing the lower voltage direct current thereto.

14. The invention according to claim 13, and said converter means including a full-wave rectifier converting said alternating current to direct current having a peak voltage generally between about 1 and about 6 volts.

15. The invention according to claim 14, and said full wave rectifier converting said alternate current to direct current having a peak voltage of from about 1 to about 3 volts.

16. The invention according to claim 1, and said first set of signal elements being supported in generally the configuration of an arrow.

17. The invention according to claim 1, and said light-emitting diode elements each having a central axis and emitting light primarily within an acute angular range of about 12.5 degrees about the central axis, the light-emitting diode elements being positioned on a display support structure so that the central axis of said light-emitting diode elements are generally parallel to each other and perpendicular to the surface of said panel for optimal visibility of the traffic-related message.

18. The invention of claim 1 wherein said message is a traffic-control message.

19. The invention of claim 1 wherein said message is an advisory message.

20. The invention of claim 1 wherein said message is a street identification message.

21. A high resolution traffic message signal device comprising:

a display support structure including a flat non-reflective panel support;

a first set of signal elements supported on the panel support in a configuration corresponding to a first traffic-related message;

a second set of signal elements supported on the panel support in a configuration corresponding to a second traffic-related message;

each of the signal elements comprising a high intensity light-emitting diode element, and power means for supplying electrical current to said light-emitting diode elements, said power means including a first supply means for transmitting electrical current connected with the light-emitting diode elements of the first set of signal elements, a second supply means for transmitting electrical current connected with the light-emitting diode elements of the second set of signal elements, said first and said second supply means including a center tap secondary winding of a step-down transformer having a first outboard tap, a second outboard tap and a center tap;

a first diode in a first conductor connected to said first outboard tap; and a second diode in a second conductor connected to said second output tap;

said diodes being commonly oriented to selectively allow conduction in the first and the second conductor;

and a controller means for selectively controlling the flow of electrical current in said first and second supply means to the light-emitting diode elements, whereby the controller means selectively causes the illumination of the first and second sets of signal elements to selectively make visible the first and second traffic-related messages.

22. The invention according to claim 21, and said light-emitting diode elements each having a central axis and emitting light primarily within an acute angular range of about 12.5 degrees about the central axis, the light-emitting diode elements being positioned on the panel support so that the central axis of said light-emitting diode elements are generally parallel to each other for optimal visibility of the traffic-related messages.

23. The invention according to claim 22 wherein:

said first set of signal elements emits red light; and said second set of signal elements emits green light.

24. The invention of claim 21 wherein said message is a traffic-control message.

25. The invention of claim 21 wherein said message is an advisory message.

26. The invention of claim 21 wherein said message is a street identification message.

27. A traffic-related message signal device connected to a conventional vehicular traffic signal and sharing a common supply of power comprising:

a housing including a substantially planar support portion;

a plurality of light-emitting diode elements supported on the support portion in a pattern defining a traffic-related message, each diode element of the plurality defining the traffic-related message being in electrical parallel with the remaining diode elements of the plurality defining the traffic-related message and the light emitted from said diodes being directly perceivable by a pedestrian as the traffic-related message;

power supply means for transmitting electrical current being connected with the common source of power and supplying a common voltage to each of the light-emitting diode elements;

light-emitting diode elements being directional high-intensity limited dispersion light-emitting diode elements, and emitting light primarily in the general direction of a central axis of the element responsive to application of electrical current thereto;

said light-emitting diode elements being positioned so that the central axis thereof are generally parallel and generally perpendicular to the substantially planar support portion for optimal visibility of the traffic-related message;

said power supply means including a controller means for selectively controlling the flow of electrical current to the light-emitting diode elements, and selectively illuminating and extinguishing the light-emitting diode elements to display the traffic-related message when desired.

28. The invention according to claim 27, and said support portion having a substantially non-reflective surface portion providing a contrasting back drop to the light-emitting diode elements when illuminated.

29. A message signal device for providing a high resolution signal to vehicular or pedestrian traffic comprising:

a display support structure including a non-reflective panel member which is substantially flat;

a set of signal elements supported on said panel;

said signal elements being arranged in a configuration corresponding to a message having a traffic-related significance in a human language;

each of the signal elements comprising a high intensity light-emitting diode element having an angle of dispersion about a central axis which is substantially perpendicular to said panel member, each diode in the set being connected in electrical parallel with every other diode in the set; and power supply means for supplying electrical power being connected with said light-emitting diode elements, and light-emitting diode elements generating light responsive to power being applied thereto, whereby the traffic-related message formed by illuminated diodes is only perceived by traffic when the diodes are illuminated.

30. The invention according to claim 29, and said cover means comprising a plate of substantially transparent material selected from the group consisting of acrylic material and polycarbonate material.

31. The invention according to claim 29, wherein said traffic-related message comprises at least one character recognizable to human viewers;

said light-emitting diode elements being positioned substantially only in single file generally along only the perimeter of each character of the represented traffic-related message so that the outline of each character forming the traffic-related message is perceived.

32. The invention according to claim 29, and each of the light-emitting diode elements being spaced generally in the range of from about one quarter inch to about one-half inch center to center from the nearest adjacent light-emitting diode elements forming each character of the traffic-related message.

* * * * *